US005111731A

United States Patent [19]

Grabner

[11] Patent Number: 5,111,731

[45] Date of Patent: May 12, 1992

[54] LOADING DEVICE FOR MODULAR PROPELLING CHARGES

[75] Inventor: Dieter Grabner, Willich, Fed. Rep. of Germany

[73] Assignee: Rheinmetall GmbH, Dusseldorf, Fed. Rep. of Germany

[21] Appl. No.: 585,010

[22] Filed: Sep. 19, 1990

[30] Foreign Application Priority Data

Sep. 27, 1989 [DE] Fed. Rep. of Germany ..... 3932130

[51] Int. Cl.[5] ..... F41A 9/14; F41A 9/16; F41A 9/42

[52] U.S. Cl. ..... 89/46; 89/47

[58] Field of Search ..... 89/33.05, 36.13, 45, 89/46, 47

[56] References Cited

U.S. PATENT DOCUMENTS

| | | | |
|---|---|---|---|
| 1,326,789 | 12/1919 | Schneider | 89/47 |
| 2,785,607 | 3/1957 | Henström et al. | 89/45 |
| 4,677,894 | 7/1987 | Pongratz et al. | 89/45 |
| 4,706,544 | 11/1987 | Zielinski et al. | 89/46 |

FOREIGN PATENT DOCUMENTS

| | | | |
|---|---|---|---|
| 0178484 | 4/1986 | European Pat. Off. . | |
| 0256250 | 2/1988 | European Pat. Off. . | |
| 2818279 | 11/1979 | Fed. Rep. of Germany | 89/45 |
| 3306934 | 8/1984 | Fed. Rep. of Germany . | |

*Primary Examiner*—Stephen C. Bentley
*Attorney, Agent, or Firm*—Spencer, Frank & Schneider

[57] ABSTRACT

A loading device for loading a propelling charge into a chamber of a gun barrel having a breech ring, wherein a loading trough is disposed behind the breech ring with the chamber beginning at the rear of the breech ring and the gun barrel has a bore axis. A transfer arm is mouonted for pivotal movement in a direction about an elevation axis of the gun barrel. A loading tray is pivotal transversely to the direction of movement of the transfer arm from a first position off the bore axis of the gun barrel to a second position aligned with the bore axis of the gun barrel and behind and separated from the breech ring. A pivoting device is connected to the transfer arm and the loading tray for pivoting the loading tray between the first and second positions. A displacement device is operatively connected with the loading tray for moving the loading tray along an extension of the bore axis of the gun barrel from the second position through the loading trough to a third position where the loading tray is in contact with the rear of the breech ring. A transporting device is operatively connected with the loading tray for transporting a propelling charge disposed on the loading tray when the loading tray is the third position into the chamber of the gun barrel.

9 Claims, 3 Drawing Sheets

LOADING DEVICE FOR MODULAR PROPELLING CHARGES

BACKGROUND OF THE INVENTION

The present invention relates to a device for loading a propelling charge, and particularly for loading modular propelling charges, into the chamber of a gun barrel through the breech ring of the gun.

Such a loading device is disclosed in German Patent No. 3,437,588.A1 and corresponding U.S. Pat. No. 4,706,544. This loading device is able to pivot propelling charge modules from a transfer position alongside the gun barrel to behind the breech ring of the gun barrel. These documents, however, do not disclose a way of automatically guiding the propelling charge modules into the chamber through an existing downwardly oriented loading trough behind the breech ring.

SUMMARY OF THE INVENTION

It is an object of the present invention to provide a loading device which not only automatically pivots propelling charge modules picked up alongside the gun barrel about a transfer arm that is pivotal about the trunnion (elevation) axis of the gun, but also automatically and reliably guides the propelling charges out of the position behind the breech ring through eh preferably downwardly open free space in the breech ring loading trough and into the chamber of the gun barrel.

The above and other objects are accomplished according to the invention by the provision of a loading device for loading a propelling charge into a chamber of a gun barrel having a breech ring, wherein a loading trough is disposed behind the breech ring with the chamber beginning at the rear of the breech ring and the gun barrel has a bore axis, the loading device including: a transfer arm mounted for pivotal movement in a direction about an elevation axis of the gun barrel; a loading tray pivotal transversely tot eh direction of movement of the transfer arm from a first position off the bore axis of the gun barrel to a second position aligned with the bore axis of the gun barrel and behind and separated from the breech ring; pivoting means connected tot he transfer arm and the loading tray for pivoting the loading tray between the first and second positions; displacement means operatively connected with the loading tray for moving the loading tray along an extension of the bore axis of the gun barrel from the second position through the loading trough to a third position where the loading tray is in contact with the rear of the breech ring; and transporting means operatively connected with the loading tray for transporting a propelling charge disposed on the loading tray when the loading tray is the third position into the chamber of the gun barrel.

The loading device according to the invention permits successive automatic transporting movements which allow not only an automatic guidance of a propelling charge module to a position behind the breech ring, but due to the provision of the displacement device, additionally permits, in a particularly simple manner, and axial displacement of the entire pivot arm that is rotatable about the transfer arm and thus permits simultaneous axial displacement of the loading tray through he free space in the loading trough of the breech ring to the chamber immediately behind the gun barrel. The longitudinal displacement of the propelling charge modules disposed on the loading tray can then safely be guided in the region of a preferably downwardly open loading trough of the breech ring into the gun barrel chamber. In particular, the propelling charge modules are given stable support toward the bottom and, in the advanced position of the loading tray where it is in contact with the chamber, are automatically pushed into the chamber in a short time by means of the transporting device.

Due to the fact that the displacement device is configured as a component of the transfer arm that is pivotal about the elevation axis of the gun, there results a particularly space saving arrangement so that additional space for the accommodation of a displacement device is no longer required.

The displacement device has a telescope-like structure and displaces the pivot arm and thus also the loading tray in the longitudinal direction parallel to the loading tray by way of a motor driven spindle drive so that a robust drive mechanism is made available and it is possible to precisely direct the loading tray to the rear wall of the breech ring where the chamber in the gun barrel begins.

According to another feature of the invention, a lifting tube of the displacement device is moved by the spindle drive and is connected in its interior with the shaft of a drive motor, with this drive motor being mounted on its exterior to the lifting tube and thus generating the rotational movement of the loading tray about the transfer arm in a particularly simple and space saving manner by rotation of its motor housing.

In the circumferential direction, the loading tray is closed in the form of a tube so that a simple construction results and the propelling charge modules are supplied into the chamber in a protected and safe manner.

According to a further feature of the invention, the transporting device may be disposed directly at the loading tray and in a space saving manner between the webs of a pivot arm connected to the drive motor housing so that a threaded spindle for the process of supplying the propelling charge modules can be driven over a short path. A dog displaceable by the threaded spindle permits gentle transporting movement for introducing the propelling charge modules into the gun barrel chamber. According to a further feature of the invention, the dog permits simple loading of the loading tray because, during the loading process, the propelling charge modules cause the dog to be pivoted away in the loading direction about a hinge while, after the completion of the loading process, the dog is automatically pivoted back into the region of the loading tray in order to transport the propelling charge modules into the chamber. Additionally, during the transport of propelling charge modules into the chamber, the dog is advantageously stably guided in the carrying position by longitudinal lateral guides.

The present invention will now be described in greater detail with reference to an embodiment thereof that is illustrated in the drawing FIGS..

DETAILED DESCRIPTION OF THE PREFERRED EMBODIMENTS

Figure 1:
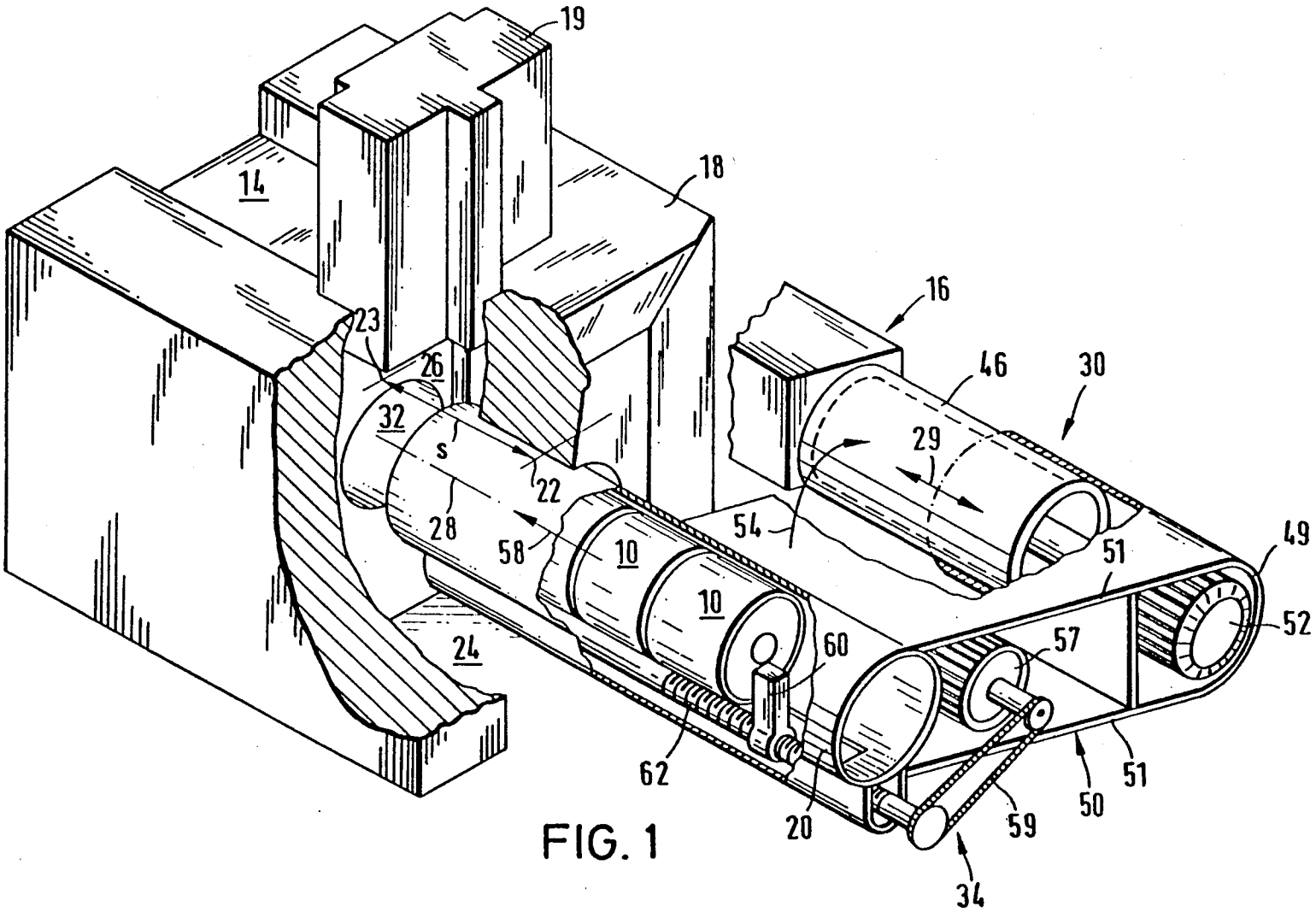
FIG. 1 is a perspective view of a loading device according to the invention and the breech ring of a gun barrel.

FIG. 1 shows a breech ring 18 connected with a barrel 14 of a gun (not shown) whose chamber 32 begins at the rear end 26 of the gun barrel, with the breech ring being closable by a vertically closing wedge-type breechblock 19. Behind breech ring 18 there is a downwardly oriented free space serving as loading trough 24.

Figure 2:
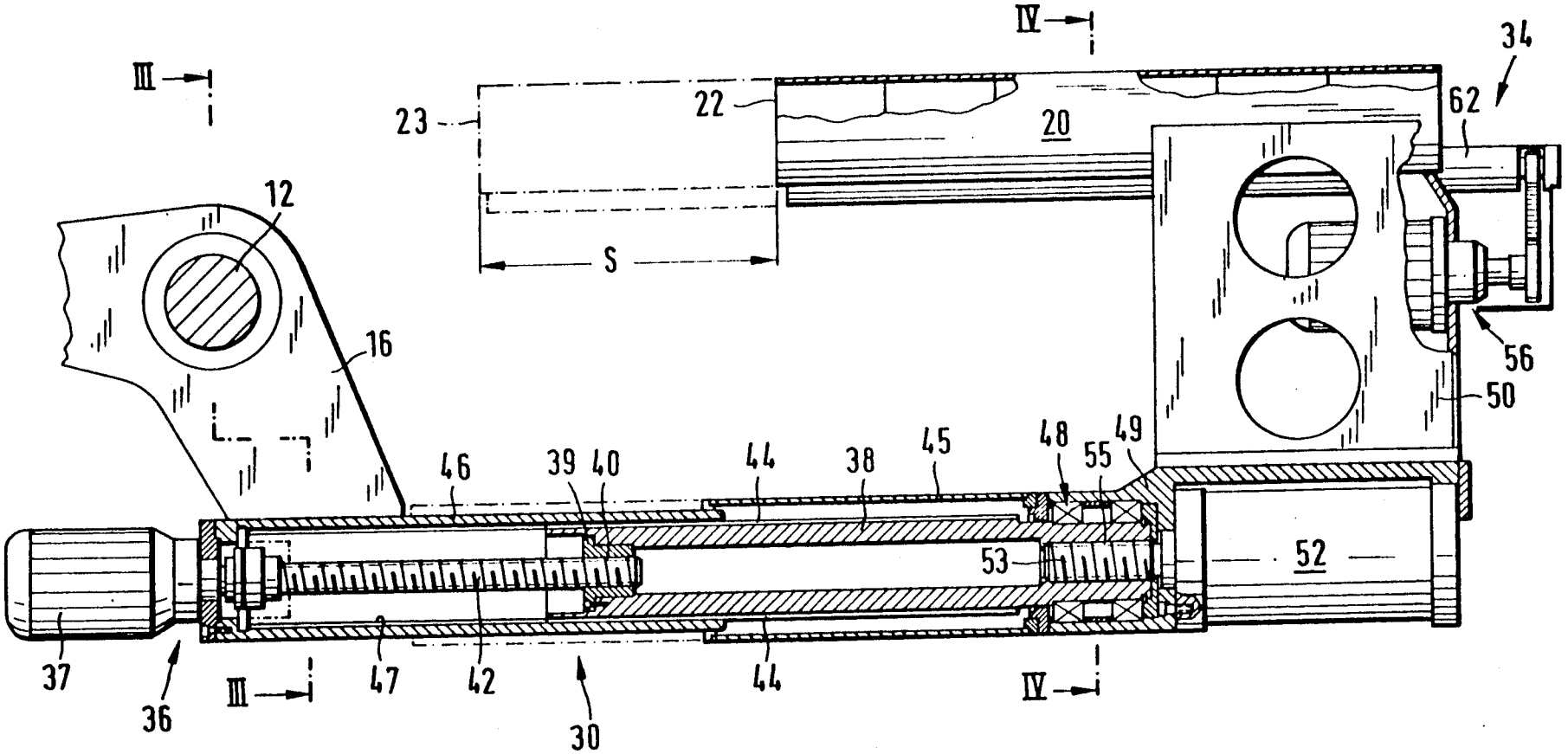
FIG. 2 is a longitudinal sectional view of the loading device seen through the transfer arm.
Figure 3:
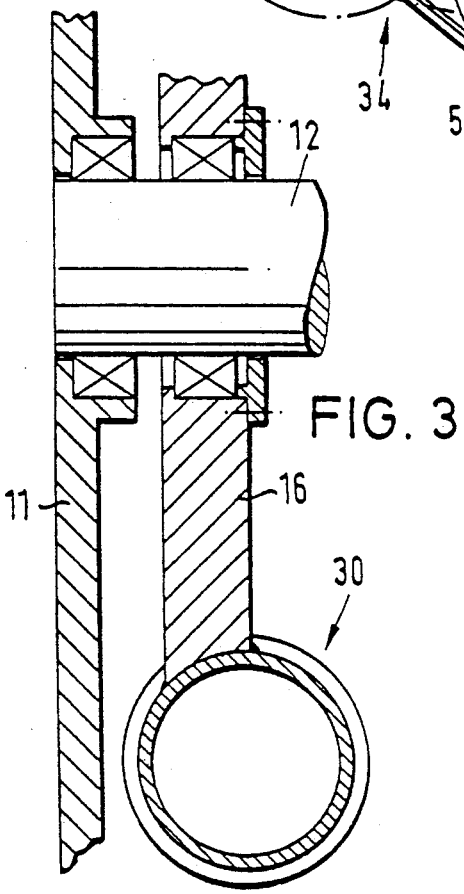
FIG. 3 is a sectional view along line III—III of FIG. 2.

The gun includes an elevation axis 12 for gun barrel 14, shown in FIGS. 2 and 3, that is based, for example, in an armored turret housing 11 and about which there is disposed a transfer arm 16 for transporting propelling charge modules 10 from a removal position alongside the gun barrel up to the elevation adjustment position of the gun barrel.

Part of transfer arm 16 is configured as a displacement device 30 movable in an axial direction 29 for correspondingly moving a loading tray 20 that additionally is pivot al about displacement device 30. The latter enables loading tray 20 to be axially moved from a position 22 behind breech ring 18 through loading trough 24 over a path S until it reaches a position 23 in which it lies against the rear side of breech ring 18 and hence at the rear end of gun barrel chamber 32 as shown in FIG. 1.

The pivoting movement about displacement device 30 is effected by a drive motor 52 fastened to a movable component of displacement device 30, as described below. A bearing housing 49 of drive motor 52 is connected by way of a pivot arm 50, composed of webs 51, with loading tray 20 which is configured as a tube.

When loading tray 20 is in position 23 on the extended bore axis 28 of the gun barrel and has been advanced to the rear 26 of gun barrel 14, a transporting device 34 disposed on the exterior of the loading tray moves a dog 60 by means of a spindle drive 62, enabling it to transport the propelling charge modules 10 disposed on loading tray 20 into chamber 32.

Displacement device 30 is enclosed in a holding tube 46 which, in its longitudinal outer side region, is connected with a web-like original component of transfer arm 16 parallel to loading tray 20. A spindle drive 36 is fastened to holding tube 46 on its side adjacent elevation axis 12. Spindle drive 36 includes a flanged-on motor 37 and a threaded spindle 42 fixed in holding tube 46 and driven by motor 37. A lifting tube 38 is axially displaceable by means of threaded spindle 42. On its interior, lifting tube 38 is connected with a bushing 39 which is equipped with an internal thread 40 to accommodate threaded spindle 42. In order to enable spindle drive 37, 42 to displace lifting tube 38 parallel to loading tray 20, the exterior of lifting tube 38 is provided with longitudinal guides 44 which, in the form of simple or spline connections, may be provided between lifting tube 38 and the interior 47 of holding tube 46.

At its end facing away from holding tube 46, lifting tube 38 is provided, on its exterior, with a bearing 48 for fastening arm 50 which is pivotal about lifting tube 38. Drive motor 52 performs the pivoting movement of arm 50 in a direction 54 (FIG. 1). On its exterior, drive motor 52 is fixed to bearing housing 49 that is rotatable about bearing 48, while an internally disposed motor shaft 53 is connected with lifting tube 38 in a non-rotatable manner by way of a feather key or spline connection 55.

To protect lifting tube 38, which can be extended in the manner of a telescope from holding tube 46 by means of spindle drive 37, 42, a protecting tube 45 is provided which is connected on one side with bearing housing 49 and on the other side slides along the exterior of holding tube 46. As evident particularly in FIGS. 4 to 6, loading tray 20 is configured as a tube and is connected by way of pivot arm 50 with bearing housing 49 of motor 52 which is able to perform a pivoting movement in direction 54. Pivot arm 50 is composed of webs 51 that are connected tangentially to loading tray 20 and to bearing housing 49.

Transporting device 34 is disposed on the exterior of tubular loading tray 20 and includes its own drive assembly 56 as well as a dog 60 (FIGS. 1 and 4) or 61 (FIGS. 5 and 6) which is driven thereby for transporting the propelling charge modules 10 disposed on loading tray 20 in direction 58 directly into chamber 32.

Figure 4:
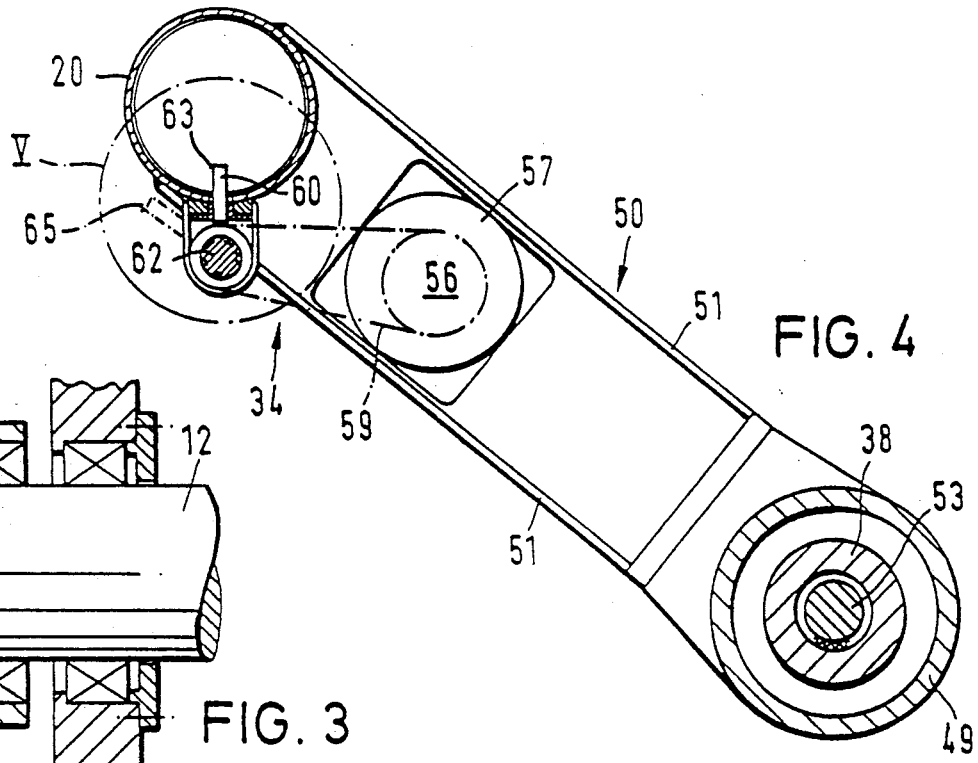
FIG. 4 is a sectional view along line IV—IV of FIG. 2.

Drive assembly 56 includes a further drive motor 57 disposed between webs 51 and a chain or belt drive 59 for driving a threaded spindle 62 disposed below loading tray 20, with this spindle, in turn, driving dog 60 itself or the sliding block 66 of a dog 61 in order to longitudinally displace dog 60, 61. In order to load loading tray 20, dog 60 may be pivoted by a cam (not shown) from a transporting position 63 into a position 65 outside of loading tray 20 as shown in FIG. 4.

Figure 5:
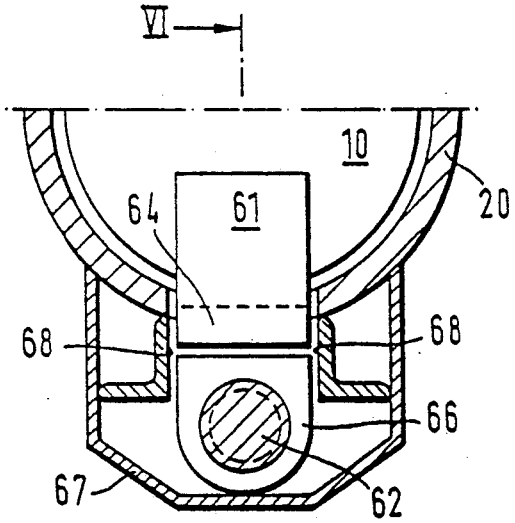
FIG. 5 is a variation of the embodiment of the dog shown in region V of FIG. 4.
Figure 6:
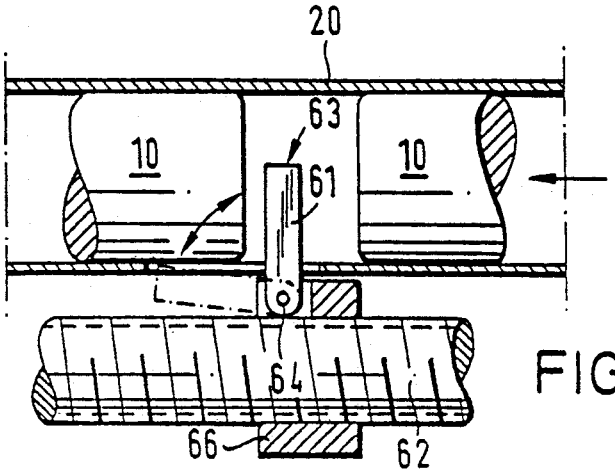
FIG. 6 is a sectional view along the line VI—VI in FIG. 5.

As shown in FIGS 5 and 6, dog 61 is connected by way of a hinge 64 with sliding block 66 disposed on threaded spindle 62 and can thus by pivoted downward, by way of a spring (not shown), from transporting position 63 in the region of loading tray 20 during loading of the propelling charge modules 10 and, once the loading process is completed, will automatically pivot back.

Dogs 60 and 61 and/or sliding block 66 are supported on their sides in longitudinal guides 68 so as to realize a linear transporting movement. These guides may be configured as a longitudinally extending recess in loading tray 20 or additionally, for example, as simple angle profiles.

Preferably, the exterior of spindle drive 62, 66 disposed below loading tray 20 is protected against soiling by a protective hood 67.

The motion sequences of the loading device comprise the following steps: after loading tray 20 is loaded in a first position off bore axis 28, transfer arm 16 pivots into a second position corresponding to the elevation of the gun barrel. In this position motor 52 pivots pivot arm 50 in direction 54 about transfer arm 16 and about the axis of holding tube 46 and lifting tube 38 until it reaches the extended bore axis 28 behind breech ring 18. By way of spindle drive 36, motor 37 moves loading tray 20 on bore axis 28 from the rear position 22 through loading trough 24 of the breech ring until it reaches a third or forward position 23 at the rear 26 of chamber 32. In this position 23 of loading tray 20, where it is in contact with the rear end of breech ring 18 and hence chamber 32, motor 57, spindle drive 62 and dog 60 or 61 of transporting device 34 transport the propelling charge modules 10 disposed on loading tray 20 into chamber 32. At the end of the loading process, the components return in the reverse order.

Obviously, numerous and additional modifications and variations of the present invention are possible in light of the above teachings. It is therefore to be understood that within the scope of the appended claims, the invention may be practiced otherwise than as specifically claimed.

What is claimed is:

1. A loading device for loading a propelling charge into a chamber of a gun barrel having a breech ring, wherein a loading trough is disposed behind the breech ring with the chamber beginning at the rear of the breech ring and the gun barrel has a bore axis, comprising:

a transfer arm mounted for pivotal movement in a direction about an elevation axis of the gun barrel;

a loading tray pivotal transversely tot eh direction of movement of said transfer arm from a first position off the bore axis of the gun barrel to a second position aligned with the bore axis of the gun barrel and behind and separated from the breech ring;

pivoting means connected to said transfer arm and said loading tray for pivoting said loading tray between the first and second positions;

displacement means constituting part of said transfer arm and operatively connected with said loading tray for moving said loading tray along an extension of the bore axis of the gun barrel from the second position through the loading trough to a third position where said loading tray is in contact with the rear of said breech ring; and transporting means operatively connected with said loading tray for transporting a propelling charge disposed on said loading tray when said loading tray is the third position into the chamber of the gun barrel.

2. A loading device as defined in claim 1, wherein said loading tray has a longitudinal dimension and said displacement means comprises a lifting tube coupled to said loading tray and a spindle drive connected to said transfer arm and operatively connected with said lifting tube for moving said lifting tube in a direction parallel to the longitudinal dimension of said loading tray.

3. A loading device as defined in claim 2, wherein said spindle drive comprises a holding tube connected with said transfer arm and a threaded spindle disposed within said holding tube, and said lifting tube has an end facing said spindle drive and including an internal thread for accommodating said threaded spindle, and an exterior surface including longitudinal guide means for axial guidance within said holding tube.

4. A loading device as defined in claim 3, wherein said lifting tube has an end remote from said spindle drive, and said pivoting means comprises a bearing surrounding said lifting tube at its end remote from said spindle drive, a pivot arm fastened to said bearing and said loading tray and a drive motor means disposed on the interior of said lifting tube and coupled to said pivot arm for pivoting said pivot arm about said lifting tube.

5. A loading device as defined in claim 4, wherein said loading tray comprises a tube, said pivot arm comprises webs fastened at sides of said loading tray tube, and said motor comprises a bearing housing connected with the webs of said pivot arm for performing the pivoting movement of said pivot arm.

6. A loading device as defined in claim 5, wherein said transporting mean is disposed outside of said loading tray tube and comprises an independent drive assembly and a dog operatively connected with said drive assembly for transporting a propelling charge on said loading tray in the direction of the bore axis immediately into the chamber of the gun barrel.

7. A loading device as defined in claim 6, wherein said transporting means comprises a second threaded spindle drivingly connected with said drive assembly and said dog is coupled with said second threaded spindle.

8. A loading device as defined in claim 7, wherein said transporting means comprises a slide block disposed on said second threaded spindle and a hinge connecting said dog with said slide block.

9. A loading device as defined in claim 8, wherein said transporting means comprises longitudinal guide means for laterally supporting said slide block and said dog while said dog is transporting a propelling charge on said loading tray.

* * * * *